United States Patent [19]

Jones

[11] Patent Number: 4,581,612

[45] Date of Patent: Apr. 8, 1986

[54] DISPLAY WITH MATRIX ARRAY OF ELEMENTS

[75] Inventor: John W. D. Jones, Stonehouse, England

[73] Assignee: Smiths Industries Public Limited Company, London, England

[21] Appl. No.: 477,794

[22] Filed: Mar. 22, 1983

[30] Foreign Application Priority Data

Mar. 29, 1982 [GB] United Kingdom ..... 8209171

[51] Int. Cl.[4] ..... G09G 3/00

[52] U.S. Cl. ..... 340/791; 340/715; 340/752; 340/766; 340/802; 343/12 A

[58] Field of Search ..... 340/791, 792, 753, 754, 340/782, 731, 701, 715, 752, 766, 781, 815.1, 815.21, 802; 455/154, 158, 159; 343/12 A; 368/84, 239, 242

[56] References Cited

U.S. PATENT DOCUMENTS

| | | | |
|---|---|---|---|
| 3,896,428 | 7/1975 | Williams | 340/731 |
| 3,936,797 | 2/1976 | Andresen, Jr. | 343/12 A |
| 3,987,401 | 10/1976 | Irving | 340/793 |
| 4,028,712 | 6/1977 | Kawamura et al. | 340/802 |
| 4,090,188 | 5/1978 | Suga | 340/731 |
| 4,240,074 | 12/1980 | Gibson et al. | 340/753 |
| 4,381,493 | 4/1983 | Mason | 340/971 |
| 4,442,424 | 4/1984 | Shirasaki et al. | 340/701 |

FOREIGN PATENT DOCUMENTS

| | | | |
|---|---|---|---|
| 0107984 | 9/1980 | Japan | 340/701 |

OTHER PUBLICATIONS

Larry Blair, "Display Bar With Double Function", Motorola Technical Developments, vol. 2, Jan. 1982.

*Primary Examiner*—Gerald L. Brigance
*Assistant Examiner*—Jeffery A. Brier
*Attorney, Agent, or Firm*—Pollock, Vande Sande & Priddy

[57] ABSTRACT

An altimeter has four display panels each being a matrix array of light-emitting diodes. An energizing unit energizes selected diodes to produce a representation of a number in each panel indicative of the value of the input. A knob on the altimeter selects input signals from a barometric source or a radar source. When barometric signals are selected, the altitude is represented in the panels by bright numbers against a dark background. When radar signals are selected, the energizing unit changes the format of energization of the display to represent altitude by dark numbers against a bright background. Other formats are also possible.

4 Claims, 5 Drawing Figures

DISPLAY WITH MATRIX ARRAY OF ELEMENTS

BACKGROUND OF THE INVENTION

This invention relates to display apparatus.

The invention is more particularly concerned with apparatus for displaying a digital value.

Display apparatus are known in which a number is represented by energizing selected ones of a matrix array of light-emitting, light-reflecting or light-absorbing elements. The elements may typically be light-emitting diodes or liquid-crystal elements. One form of such a display is described in the specification of U.S. Pat. No. 4,240,074. Instruments for indicating the value of two or more input variables may use such a display, the same display being switched between the different input variables. In order to distinguish between the different inputs, and to show with which input variable the value displayed is associated, it is common practice to reveal an appropriate legend in the display area. Alternatively, the switch used to select which input value is displayed may be suitably marked to distinguish between the different input variables. Thus, for example, in a timepiece capable of displaying both time and date, the display might have a panel bearing the legend DATE which is revealed only when the appropriate date switch is actuated on the timepiece.

This form of display can be satisfactory in certain circumstances but is less desirable where the display must be capable of being read rapidly, at a glance, since the associated legend or marking may take a significant time to locate and read. There is also the disadvantage, where the legend is provided in the display area itself, that the area of display required for the legend leads to an increase in the overall size of the display, or a reduction in the area of display devoted to representing the value of the input variable. These disadvantages can be important, especially in application in, for example, aircraft.

BRIEF SUMMARY OF THE INVENTION

It is an object of the present invention to provide display apparatus that avoids to a substantial extent the above-mentioned disadvantages.

According to one aspect of the present invention, there is provided display apparatus of the kind having a matrix array of electrically-energizable elements, and energizing means arranged to energize selected ones of said elements to provide a digital display representation of one of a plurality of input variables, wherein said display apparatus includes switching means that is operable to select an input variable and to cause the format of said display representation to be changed upon change in the selection of said input variable.

In this way, even though two input variables might have the same value—giving the same digital number in the display—the input variable selected is readily discerned by the observer, from the format of the display.

In one format, the display representation is provided by bright numbers against a darker background, and in the other format, the display representation is provided by dark numbers against a brighter background. Alternatively, the format of said display representation may be changed by changing the color of the display representation. In a further embodiment, the format of said display representation may be changed by changing the size of the digital display representation. The electrically-energizable elements may be light-emitting diodes.

The said plurality of input variables may be representative of barometric altitude and radar altitude respectively.

According to another aspect of the present invention, there is provided an altimeter including a barometric altitude source, a radar altitude source, a matrix array of electrically-energizable display elements, energizing means arranged to energize selected ones of said elements to provide a digital display representation of barometric altitude or radar altitude in accordance with the output of said barometric altitude source or radar altitude source respectively, the altimeter including switching means operable to select display of barometric altitude or the radar altitude and to cause the format of the display representation to be changed upon change in the selection of barometric or radar altitude.

An aircraft altimeter display will now be described, by way of example, with reference to the accompanying drawings.

DETAILED DESCRIPTION

Figure 1:
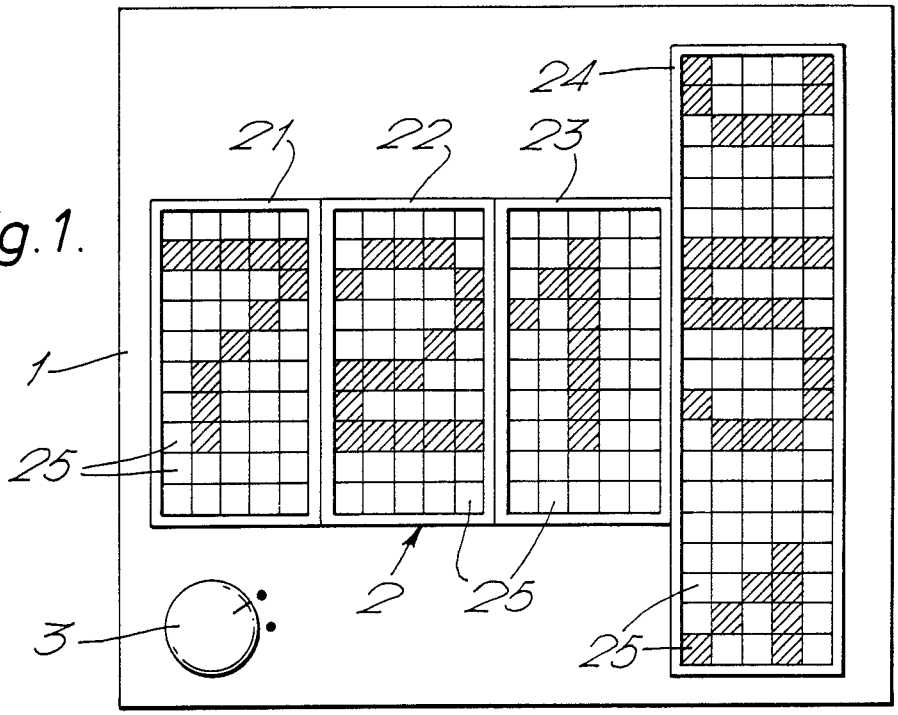
FIG. 1 shows schematically an aircraft altimeter representing the value of one input variable.

With reference to FIG. 1, there is shown an aircraft altimeter having a front face 1 on which is mounted a four-digit display unit 2 and a selector knob, or switch 3, that is operable to select display of either barometric or radar altitude.

The display unit 2 includes four panels, 21, 22, 23 and 24 each of which comprises a rectangular matrix array of light-emitting diodes 25. Each panel 21 to 24 displays one digit of the altitude value, the final, least-significant panel 24 being longer than the others and being capable of displaying a digit as it appears to move up or down the panel in accordance with change in altitude.

With the selector knob 3 in the position shown in FIG. 1, the display unit 2 provides an indication of the barometric height. This is achieved by energizing appropriate elements or diodes 25 in each panel 21 to 24 to form patterns of the individual digits to be displayed—these appear as bright elements (the hatched elements in the drawings) defining each digit, against a dark background of unenergized elements.

Figure 2:
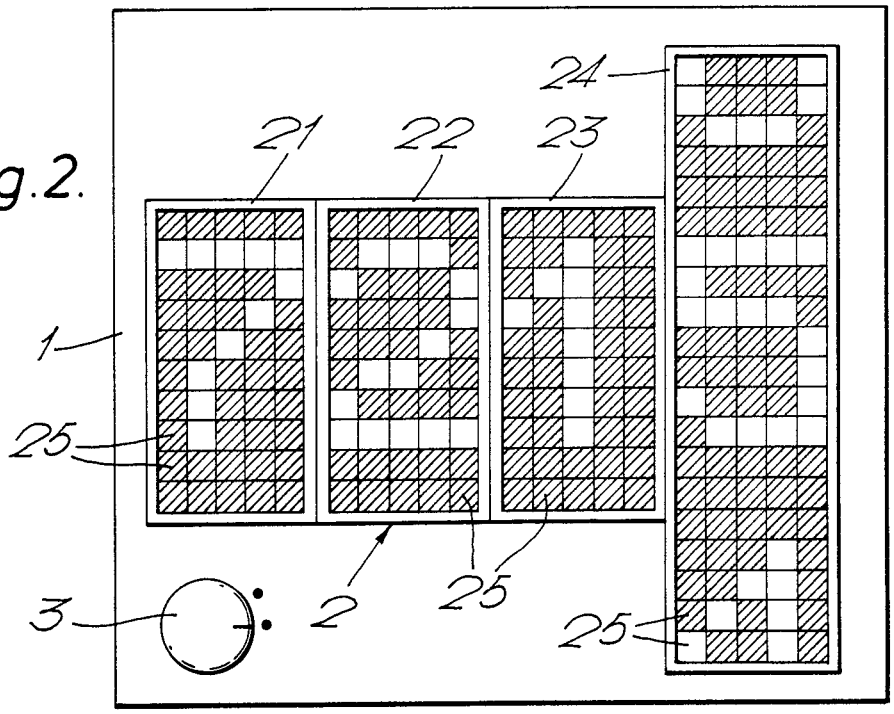
FIG. 2 shows the altimeter of FIG. 1 representing the value of another input variable.

When the selector knob 3 is operated to change the display to that of radar altitude, the format of the display is also changed, as shown in FIG. 2. In this condition, the value happens to be the same as that shown in FIG. 1 and the number displayed is identical. The format of the display, however, differs in that all the elements 25 in the panels 21 to 24 are energized except those forming the individual digits of the displayed number; the number therefore appears as dark digits on a bright background.

Figure 3:
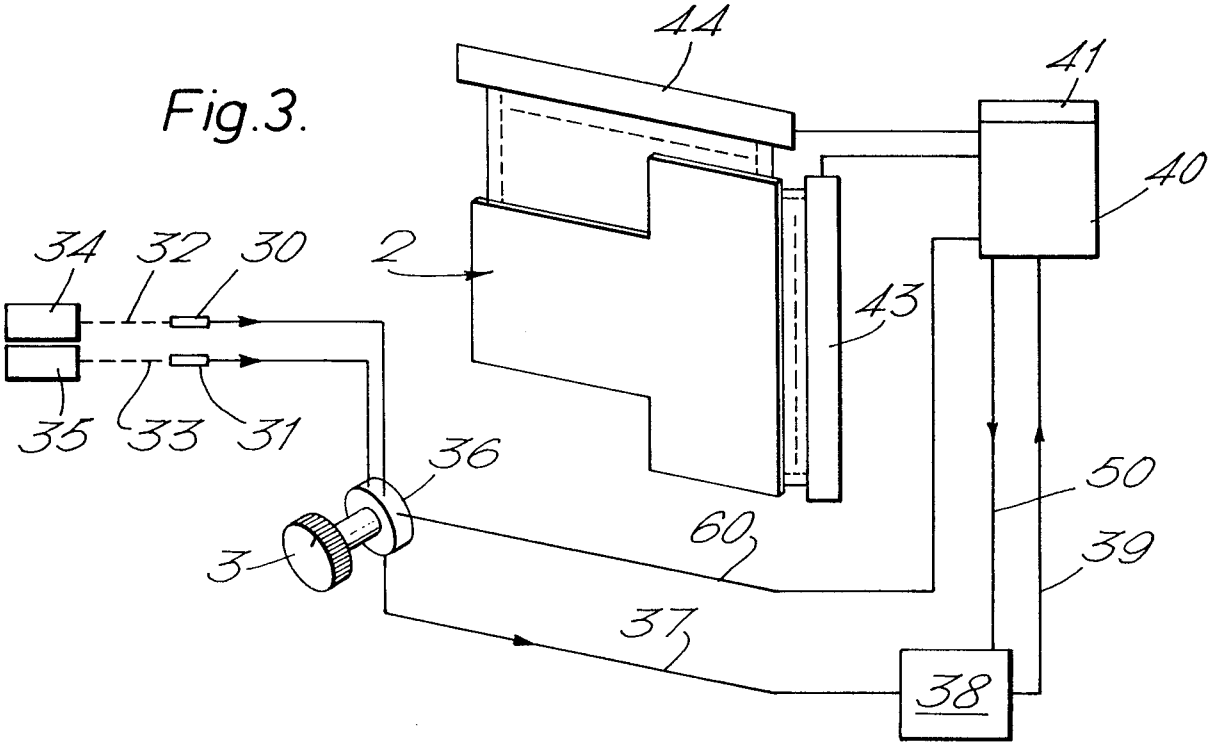
FIG. 3 shows the altimeter in greater detail.

The construction of the altimeter will now be described in greater detail with reference to FIG. 3. The instrument has two inputs 30 and 31 which are connected to lines 32 and 33 on which are supplied signals representative of aircraft altitude from a barometric source 34 and a radar source 35 respectively. The inputs 30 and 31 are both connected to the switching mechanism 36 of the knob 3 which is operable to connect one or other of the inputs to line 37, according to the position of the knob. Signals on line 37 are supplied to a converter unit 38 which is in turn arranged to supply base-address signals of a suitable form via line 39 to a display energizing unit 40. In this respect, where the input signals are in analog form, the unit 38 may include an analog-to-digital converter.

The display energising unit 40 has storage locations such as, for example, are provided by a read-only memory 41, in which are stored information defining the patterns of diodes 25 in each of the four panels 21 to 24 to be energized, in order to represent any particular four-digit number. The base-address signal on line 39 is a digital representation of an address in the memory 41 and, when supplied to the unit 40 causes the memory to read out information relating to the energization of each row of the display in turn so that an image of the required number is built up. Energization of the diodes 25 is effected using standard multiplexing techniques by means of a row diode unit 43 and a column diode unit 44. The speed at which time is carried out is sufficient to prevent any discernible flickering.

When all twenty rows of the display panels have been addressed, the energizing unit 40 supplies a signal along line 50 to the converter unit 38 to cause the converter unit to supply a new base address signal to the computer unit along line 39 in accordance with the value of the altitude at that time.

The energizing unit 40 is also coupled directly with the switching mechanism 36 of the selector knob 3 via line 60 and is responsive to the position of the knob. Thus, when the knob 3 is in a position where the input from the barometric source 34 is connected with the converter 38, the elements 25 of the display are brightened, by energizing in the conventional manner, to produce bright numbers against a dark background. When, however, the knob 3 is turned to connect the other input 31, namely the radar altitude signals, to the converter 38, the energizing unit 40 is similarly switched to display the value of the radar altitude in the alternative format by brightening all those elements of the display except those making up the individual digits of the number. In this way, the number appears as dark digits against a bright background.

The advantage of this arrangement is that it is readily apparent by glancing at the display, from its format, which input variable is being represented. Once the user has become familar with the instrument it is not even necessary to look at the position of the knob. This advantage is considerable in an aircraft cockpit with limited panel area where the instrument must be easily read during conditions of adverse illumination or vibration.

It will be appreciated that the invention is not confined to altimeters but may be applied to other instruments that are switchable to read the value of one of two or more input variables.

Figure 4A:
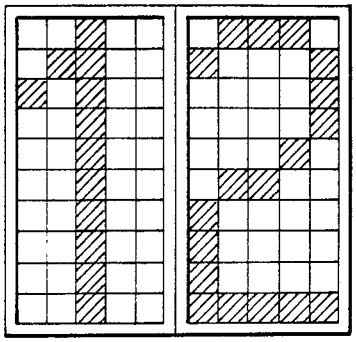
FIGS. 4A and 4B show alternative display formats.
Figure 4B:
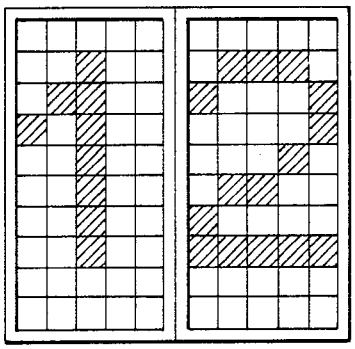

More than two different formats could be used and the change in format could be brought about in other manners to that described above. In this respect, the term 'format' is taken to mean any change in appearance which is independent of the actual value of the input variable. For example, as shown in FIGS. 4A and 4B, the format could be changed by changing the size of the displayed digits. Alternatively, the different formats could be provided by different character fouts or degrees of brightness (or darkness) of the display representations. Different colors could also be used to distinguish between formats and in this respect, the colors of the numbers, their background or both could be changed. In another embodiment, one format could be provided by a steady display of constant apparent intensity and different formats could be provided by intermittent energization to give a flashing display.

What I claim is:

1. Display apparatus of the kind having a matrix array of electrically-energizable elements, and energizng means arranged to energize a pattern of said elements such as to provide a digital display in a first format of bright numbers against a darker background representing a first of two input variables, wherein said display apparatus includes switching means, means connecting said switching means to receive said two input variables, said switching means being switchable to select a first or second of said two input variables, and means connecting said switching means to said energizing means, said switching means switching said energizing means to provide a display representation of the second of said two input variables upon change in selection of said two input variables, said display representation of the second input variable being provided in a different format of dark numbers against a bright background.

2. An altimeter comprising a barometric altitude source; a radar altitude source; a matrix array of electrically-energizable display elements; energizing means, said energizing means being arranged to energize a pattern of said elements to provide a digital display in a first format of bright numbers against a dark background or in a second format of dark numbers against a bright background; switching means; means connecting said switching means to said barometric altitude source and said radar altitude source, said switching means being switchable to select signals from said barometric altitude source or said radar altitude source for supply to said energizing means; and means connecting said switching means to said energizing means, said switching means switching said energizing means to change the format of said display representation to change between display of bright numbers against a dark background to display of dark numbers against a bright background upon change in the selection of barometric or radar altitude.

3. Display apparatus according to clam 1, wherein said electrically-energisable elements are light-emitting diodes.

4. Display apparatus according to claim 1 or 3, wherein said first and second input variables are representative of barometric altitude and radar altitude respectively.

* * * * *